United States Patent [19]

Taft

[11] Patent Number: 4,796,319

[45] Date of Patent: Jan. 10, 1989

[54] COMBINATION SCREW-TAPPING AND SCREWDRIVING TOOL

[76] Inventor: David Taft, 2 Capron St., Uxbridge, Mass. 01569

[21] Appl. No.: 60,654

[22] Filed: Jun. 11, 1987

[51] Int. Cl.[4] ..... B25F 3/00

[52] U.S. Cl. ..... 7/158; 7/165; 408/225

[58] Field of Search ..... 7/158, 165; 408/202, 408/203, 225

[56] References Cited

U.S. PATENT DOCUMENTS

| | | | |
|---|---|---|---|
| 162,315 | 4/1875 | Shaw et al. | 408/202 |
| 385,791 | 7/1888 | Carpenter | 7/165 |
| 524,906 | 8/1894 | McDougall | 7/165 |
| 679,693 | 7/1901 | Burkhart | 408/202 |
| 1,678,124 | 7/1928 | Perreault | 7/165 |
| 3,336,611 | 8/1967 | Schepp | 408/202 |
| 3,575,520 | 4/1971 | Halpern | 408/225 |
| 4,092,753 | 6/1978 | Fuhrmann | 7/165 |
| 4,218,795 | 8/1980 | Ernst | 7/158 |

*Primary Examiner*—Roscoe V. Parker

[57] ABSTRACT

A drill accessory kit for mounting screw-type fasteners is comprised of several drill bit holders and a screwdriving attachment. The bit holder engages a common twist drill bit in the chuck of a drill and allows one to drill a pilot hole to a desired depth in a workpiece with a cutting action which provides a proper-shaped hole for clean flush mounting or countersinking of a screw. Subsequently, the screwdriver attachment slips over the drill bit and engages with the bit holder, allowing a quick change from drilling to powerdriving of a screw.

2 Claims, 1 Drawing Sheet

COMBINATION SCREW-TAPPING AND SCREWDRIVING TOOL

BACKGROUND OF THE INVENTION

1. Field of the Invention

There are a number of screw fastening applications that require a pilot hole be drilled into the workpiece, a means provided for flush mounting or countersinking of a screw, and subsequently, a screw to be power driven into the workpiece. This task has commonly required (1) using two different tools, one for drilling and one for power driving a screw, or (2) removing the bit from the chuck of a drill and inserting a screwdriving attachment. The use of a single tool to perform the prescribed task with ease and quickness would be highly desirable.

It is the purpose of this invention to provide such a tool.

2. Description of the Prior Art

A tool is currently available which allows one to engage a specialty drill bit into a bit holder and to secure it in place by means of a set screw. Upon subsequent drilling of a pilot hole in a workpiece, a hollow cylyndrical screwdriver attachment is fitted over the drill bit and engaged with the bit holder in a fixed fashion, providing a set-up for powerdriving a screw. This device, while good for limited applications, has several disadvantages: (1) a specialty drill bit that will engage with the set screw on the bit holder is required; (2) there is no adjustment for easily setting a desired pilot hole depth; (3) there is no cutting action to provide the proper shaped hole for clean flush mounting or countersinking of a screw. This invention eliminates these problems.

SUMMARY OF THE INVENTION

The invention consists of a drill bit holder and a screwdriver assembly. The bit holder engages a common twist drill bit in the chuck of a drill and allows one to easily drill a pilot hole into a workpiece with a cutting action that provides a proper shaped hole for flush mounting or countersinking of a screw. Subsequently, the screwdriver assembly slips over the drill bit and engages with the bit holder, allowing a quick change from the drilling to powerdriving of a screw.

DESCRIPTION OF THE PREFERRED EMBODIMENT

Figure 2:
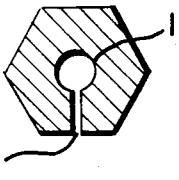
FIG. 2 is a cross-sectional view of the drill bit holder in FIG. 1.
Figure 1:
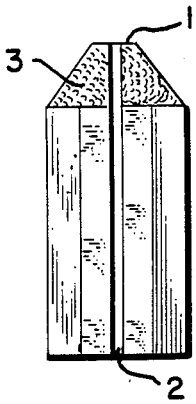
FIG. 1 is a side elevation view of the drill bit holder.

Referring to FIGS. 1 and 2, the drill bit holder, a hexagonal rod of non-brittle metallic substance with a cylyndrical hole [1] centered radially and passing longitudinally through the body. The diameter of said hole would correspond to the diameter of a specific twist drill bit diameter. The bit holder has a slot[2] running longitudinally down one side and extending radially from the center hole to the outside surface. The top of the bit holder[3] is cone-shaped and of an abrasive nature to provide a cutting action in wood, plastic or other suitable material.

It is to be understood that one bit holder holds only one size diameter twist drill bit. Therefore, a screw powerdriving kit would include several bit holders in which the center cylyndrical hole diameter would correspond equally to common pilot hole diameters recommended for common screw diameters on the market.

Figure 3:
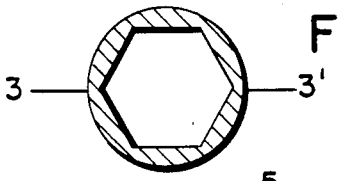
FIG. 3 is a cross-sectional view of the screwdriver assembly.
Figure 4:
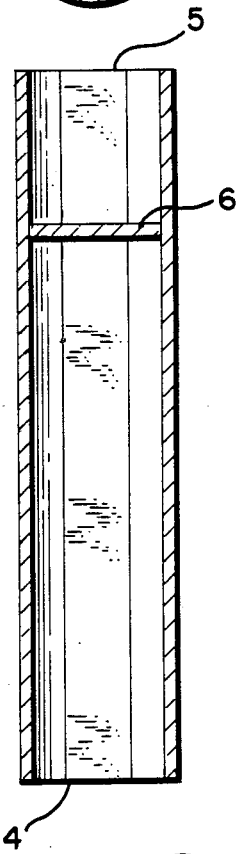
FIG. 4 is a sectional side view of the screwdriver assembly cut along plane 3—3 of FIG. 3.

Referring to FIGS. 3 and 4, the screwdriving attachment includes a hollow cylyndrical tube of metallic substance of which the magnetic nature if opposite that of the bit holder. The interior surface is shaped similarly at both ends. At the end that accepts the bit holder[4], a hexagonal shape corrosponding to the hexagonal shape of the bit holder. At the end that powerdrives a screw[5], the interior surface is hexagonally shaped to accept an insert bit for screwdriving. A stop[6] is provided to fix the insert bit 10 in place while the magnetic nature of the screwdriver attachment holds it there.

Figure 5:
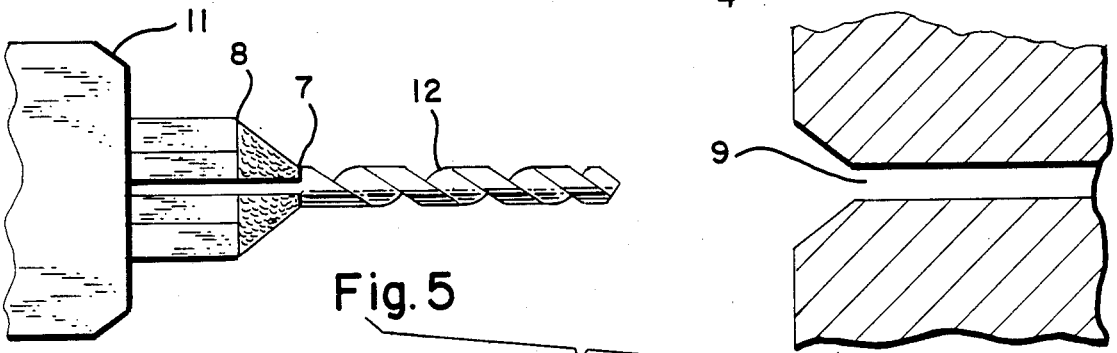
FIG. 5 shows the drill, drill bit holder and drill bit assembly and the subsequent pilot hole in a workpiece.

Referring to FIG. 5, the device is used as follows: The proper bit holder is selected with its corresponding sized twist drill bit. The bit is passed through the center hole of the bit holder to a desired position as indicated by the length of the exposed portion of the bit[12] and determined by the desired depth of the pilot hole.

The assembly is then secured in the chuck of a drill[11]. Upon tightening of the drill chuck, the bit holder is forced to contract radially around the drill bit, holding it firmly in place.

The drill assembly is now ready for drilling. The drill bit and bit holder can be plunged into a workpiece to point 7 for a simple uniformly cylyndrical hole, to point 8 for flush mounting, flat-headed screws, or deeper for countersinking.

Figure 6:
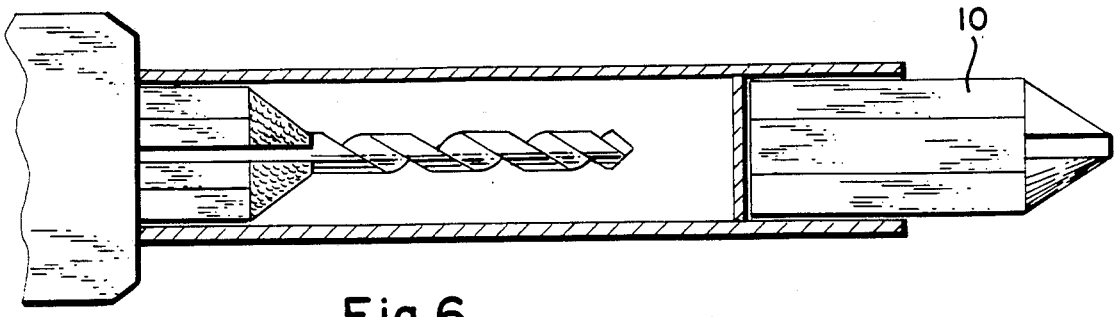
FIG. 6 shows the drill assembly with the screwdriver attachment engaged for powerdriving a screw.

Referring to FIG. 6, subsequent to drilling of a pilot hole[9], the screwdriver attachment with the desired insert bit engaged in the top end[10] is slipped over the drill bit from the bottom end and is engaged with the hexagonal bit holder in a fixed fashion rotationally and kept in place by magnetic attraction. The drill assembly is now equipped to drive a screw into the pilot hole.

I claim, therefore, that my invention represents a significant improvement over the prior art in that:

1. A drill bitholder, said holder being a hexagonal rod with a cylindrical aperture running longitudinally down the center, a slot running longitudinally the length of the holder and extending radially from the center aperture to the outside hexagonal surface, said holder having at one end a conical tip with an abrasive cutting means, said central cylindrical aperture corresponding in diameter to specific drill bit sizes recommended for the drilling of pilot holes for specific screw sizes, whereby the corresponding drill bit is inserted through the aperture of the bitholder to a desired depth relative to the conical end of the bitholder, the conical end being the frontal end with the bit extending from it outward to the bit tip, said depth determined by the desired pilot hole depth, whereupon the drill bitholder is engaged distal end first in the chuck of a drill for up to two-thrids its length, and upon tightening of the chuck, the inward pressure of the chuck forces the bitholder to contract radially against the drill bit, holding it firmly in place, said assembly ready for drilling a pilot hole to a preferred shape, said shape corresponding in whole or in part to the embodiments of the bit and bitholder assembly, said embodiments being the cylindrical shaft of the bit, the conical flared end of the bitholder, and the enlarged cylindrical shape produced by the hexagonal bitholder in rotation, said pilot hole shape determined by the depth with which the tool is forced into the workpiece to produce the desired hole for simple flush-mounting, countersinking, or counterboring of various screw types.

2. The drill bitholder of claim 1 in combination with a screw driver attachment, said attachment having first, second, and third portions, said first portion having a hexagonal aperture for engaging the hexagonal surface of the drill bitholder, said second portion having a longitudinally extending aperture of sufficient length to house the drill bit extending from the bitholder, said third portion having a hexagonal aperture with a magnetic stop to house common insert bits for driving fasteners, said attachment to be slipped over the drill bitholder-drill bit assembly and engaged with the hexagonal surfaces to provide a means for driving a fastener.

* * * * *